US007001220B2

(12) United States Patent
Thörner et al.

(10) Patent No.: US 7,001,220 B2
(45) Date of Patent: Feb. 21, 2006

(54) COAXIAL PLUG-AND-SOCKET CONNECTION

(76) Inventors: Wolfgang B. Thörner, Hatzper Str. 125, D-45149 Essen (DE); Fritz J. Reich, Zedernweg 6, D-44799 Bochum (DE)

( * ) Notice: Subject to any disclaimer, the term of this patent is extended or adjusted under 35 U.S.C. 154(b) by 32 days.

(21) Appl. No.: 10/493,520

(22) PCT Filed: Dec. 12, 2003

(86) PCT No.: PCT/EP03/14160

§ 371 (c)(1),
(2), (4) Date: Apr. 23, 2004

(87) PCT Pub. No.: WO2004/055948

PCT Pub. Date: Jul. 1, 2004

(65) Prior Publication Data

US 2004/0253843 A1 Dec. 16, 2004

(30) Foreign Application Priority Data

Dec. 13, 2002 (DE) ..... 102 58 689

(51) Int. Cl.
*H01R 24/00* (2006.01)

(52) U.S. Cl. ..... 439/675; 439/578; 439/352; 439/394

(58) Field of Classification Search ..... 439/675, 439/578, 335, 337, 63, 851, 583–584, 394, 439/427, 461–462, 308–309, 352
See application file for complete search history.

(56) References Cited

U.S. PATENT DOCUMENTS 3,437,982 A * 4/1969 O'Keefe et al. ..... 439/578
4,300,338 A 11/1981 Harman et al.
5,066,248 A * 11/1991 Gaver, Jr. et al. ..... 439/578
5,376,022 A 12/1994 Carr et al.
5,564,942 A 10/1996 Lee
5,649,838 A * 7/1997 Sung ..... 439/578
6,297,741 B1 * 10/2001 Higgins ..... 340/631
6,533,617 B1 * 3/2003 D'Addario ..... 439/669
6,568,964 B1 * 5/2003 D'Addario ..... 439/675
6,692,285 B1 * 2/2004 Islam ..... 439/352
6,705,884 B1 * 3/2004 McCarthy ..... 439/394
6,796,829 B1 * 9/2004 McCarthy ..... 439/394

FOREIGN PATENT DOCUMENTS

| | | |
|---|---|---|
| DE | 199 08 469 A 1 | 9/2000 |
| DE | 199 27 713 C1 | 1/2001 |
| EP | 1 049 206 A2 | 4/2000 |
| JP | 8-306443 | 11/1996 |
| WO | WO 00/70717 | 11/2000 |

* cited by examiner

*Primary Examiner*—Truc T. Nguyen
*Assistant Examiner*—Edwin A. Leon
(74) *Attorney, Agent, or Firm*—Collard & Roe, P.C.

(57) ABSTRACT

The invention relates to a socket (1) for a coaxial electrical plug-in connector as well as a pertaining plug. The socket (1) is comprised of an inner contact opening (2) with an inner contact element (3) arranged therein. The inner contact opening (2) is surrounded by an outer plug (4) being of a circular-cylindrical construction, said plug having an outer contact element. To improve the electrical properties of such a socket on transmission of audio and video signals between devices applied in consumer electronics, the present invention proposes an outer plug (4) to be made of an electrically insulating material, with the outer contact element being designed and built as a contact strip (6) in its contact area, with the curvature of said contact strip forming a circular-cylindrical helical curve on the outside of said outer plug (4).

24 Claims, 5 Drawing Sheets

COAXIAL PLUG-AND-SOCKET CONNECTION

CROSS REFERENCE TO RELATED APPLICATIONS

Applicants claim priority under 35 U.S.C. §119 of German Application No. 102 58 689.6 filed Dec. 13, 2002. Applicants also claim priority under 35 U.S.C. §365 of PCT/EP03/14160 filed Dec. 12, 2003. The international application under PCT article 21(2) was not published in English.

BACKGROUND OF THE INVENTION

1. Field of the Invention

The present invention relates to a socket for a coaxial electrical plug-in connector comprising an inner contact opening, an inner contact element located therein, and an outer plug surrounding the inner contact opening and being of a circular-cylindrical construction, said outer plug having an outer contact element.

The invention furthermore relates to an electrical connector plug comprising a plug body which an electrically insulating carrier element for an inner contact pin is affixed to, and comprising an outer contact element spaced radially from the inner contact pin relative to the longitudinal axis of said plug.

2. Description of the Related Art

Coaxial plug-in connectors of this type are known under the designation "cinch plugs" or "RCA plugs", serving for establishing a detachable cable connection between consumer electronics devices for the purpose of asymmetrically transmitting audio or video signals.

Conventional RCA plugs usually have an outer contact of a hollow cylindrical construction arranged coaxially towards the inner contact pin. This outer contact is usually comprised of a ring-shaped metal strip having slots extending in axial direction. By means of this slotted metal strip, the plug engages in an outer plug of a pertaining cinch or RCA socket, said plug also being of a circular-cylindrical shape. The spring-resilient properties of the slotted metal strip of the outer contact are utilized for such RCA plug-in connectors to establish a friction-locked connection of the plug with the socket.

Known from EP 1 049 206 A2 is a socket for a coaxial electrical plug-in connector comprised of an outer contact element being of a circular cylinder construction. Mounted at the inside of the outer contact element is a spring-resilient contact wire, the curve of which may be helical at the inside of the outer contact element. The contact wire determines the plug-in and pull-out force for the connection of said socket with an appropriate plug.

A mounting socket for a coaxial electrical plug-in connector is furthermore known from JP 08-306443 A. With this socket, the outer contact element is of a circular cylinder construction, with elevations being provided on the outside of the outer contact element, said elevations extending on the outside of the outer contact element in a circular ring shape or like a broken helical curve. These elevations are designed to improve the contact properties of the outer contact element of the socket with the relevant outer contact element of a pertaining plug.

Another socket for accommodating a coaxial plug is known from DE 199 08 469 A1. The plug to be entered into said socket has a circumferential groove, thus leading to a latching of the plug in the socket.

Furthermore known from DE 199 27 713 C1 is a multiple coupler for coaxially shrouded sockets, which is destined for applications in high-frequency technology. Provided for said coupler is a tensioning device which serves to apply the clamping forces between resilient contact elements of plugs and the corresponding outer contact elements of the sockets to be contacted to establish the contact.

It is known that plug-in connectors of the type described hereinabove have sub-optimal properties with regard to the quality of transmitting audio and video signals. The coaxial arrangement composed of an inner contact pin and an outer contact basically determines the impedance with conventional plug-in connectors. A major problem is to be faced because the impedance of the plug is by no means adapted to the wave resistance of the applied cable, thus causing reflections of the transmitted signal at the point of connection. This problem attains specific relevance, if digital audio or video signals are transmitted with a high data rate through the plug-in connector. Due to non-linear signal distortion, this may lead to bit faults and substantial data losses, thus drastically diminishing the quality of playback of audio and video signals transmitted through the plug-in connector. However, it is disadvantageous that linear distortion occurs already on transmission of analogous audio and video signals, which adversely affects the quality of playback. Furthermore it is known that induced eddy currents may form due to the flow of electric current through the inner contact pin in the circular-cylindrical metal strip of the outer contact, said eddy currents interfering with the signal in a hardly predictable manner and thus adversely affecting the transmission of signals.

Known from WO 00/70717 is an RCA plug, which allows for establishing a plugged connection with a conventional RCA socket, whereby the disadvantages outlined hereinabove are partly avoided.

Instead of the usually slotted metal strip, the prior art RCA plug has an axially directed, pin-shaped outer contact element which is fixed relative to the inner contact pin by means of a carrier element made of plastic material in a functional position required for establishing the electrical contact. To hold the plug at the pertaining socket, a collar section also made of plastic material is molded to the carrier element, said collar section latching at the circular-cylindrical outer contact of the socket. The pin-shaped outer contact is embedded in the plastic material of the collar section, so that the contact pin is pressed from outside against the outer contact of the socket when the plug is plugged into the socket. The pin-shaped outer contact with the prior art RCA plug in its contact area is of a cylindrical or even spherical or ellipsoidal construction.

Though the impedance behavior of the RCA plug known from the printed publication mentioned hereinabove is clearly different from the impedance behavior of conventional RCA plugs as described before, which is particularly attributable to the waiver for the hitherto usual metal strip as mass contact which is arranged coaxially towards the inner contact pin. However, when establishing an electrical plug-in connection with an RCA plug of this type, there is a problem in that those negative properties described before still exist on the part of the socket, which the plug is plugged into. The inner contact opening where the inner contact pin of the plug plugged into the socket is located in a conventional RCA socket is entirely surrounded by the metallic body of the outer plug of the socket, which forms the outer contact element. The circular cylindrical metal shell of the outer plug basically determines the quite substantial capacitance of the plug-in connector. Besides, the eddy currents described hereinabove can be induced in the metallic shell of the outer plug, which adversely affect the transmission of signals.

Now, against this background, it is the task of the present invention to furnish a coaxial plug-in connector which largely avoids the disadvantages and problems outlined hereinabove. By way of this invention, it is particularly intended to provide a socket for a coaxial electrical plug-in connector which shows an improved impedance behavior with regard to the transmission of signals between consumer electronics devices and in which the occurrence of eddy currents on the outer contact element is particularly avoided.

SUMMARY OF THE INVENTION

Proceeding from a socket of the initially mentioned type, this set of tasks and objectives is solved by providing an outer plug made of electrically insulating material, with the outer contact element being designed as a contact strip in its contact area, the curve of which forming a circular-cylindrical helical line on the outside of the outer plug.

In accordance with the present invention, the metal shell usually being of a circular-cylindrical shape with conventional RCA plugs is replaced with the outer plug composed of an electrically insulating material. The helically-shaped contact strip of the socket according to the present invention serves for establishing the electrical contact with the outer contact element of the plug, said contact strip being arranged on the outside of the outer plug. In this manner, the area of the outer contact element arranged coaxially towards the inner contact opening of the socket is minimized, thus leading to a substantial reduction of capacitance. As the outer contact element is of a helically shaped construction, contacts can be established anywhere on the outer circumference of the outer plug, thus ensuring that the socket can be utilized together with conventional RCA plugs. However, the configuration of the outer contact element according to the present invention prevents the formation of eddy currents in it, because the outer contact element—other than with conventional RCA sockets—does not form a coherent superficial metal body surrounding the inner contact opening.

A particularly simple and low-cost possibility to produce a socket according to the present invention is given by the fact that it is composed of a base body consisting of an electrically insulating material, said base body being of a one-partite construction with the outer plug, with the outer contact element being embedded as a metallic punched bending part into the base body. In this manner, the socket can be produced without any problem either as a cable bushing or as a socket for case mounting.

The contact strip of the outer contact element according to the present invention is expediently laid into a helical groove mounted at the outside of the outer plug. It is thus ensured that the outer contact element is safely fixed at the outer plug, even if forces act upon the contact strip of the outer contact element in axial direction when a plug is plugged into the socket.

Moreover, it is advantageous for a simple and low-cost production of the socket according to the present invention, if the inner contact element is embedded in a carrier body made of an electrically insulating material, said carrier body being insertible into an appropriate bore of the base body. The carrier body, which accordingly forms the interior of the socket together with the inner contact element, for example, can be inserted from the rear into the base body of the socket, without having to dismantle the outer plug arranged at the front side of the socket.

It is particular expedient, if the helical curve pass height of the socket according to the present invention corresponds basically to the length of the outer plug. As a contact with the outer contact element on the outside of the outer plug is thereby possible at any place in circumferential direction and since the overall surface of the contact strip comprised of an electrically conductive material is minimized, it is ensured that the capacitance of the socket is as low as possible and that the socket is moreover compatible with any RCA plug obtainable on the market.

For the socket according to the present invention, it is expedient to produce the inner contact element and/or the outer contact element of a highly conductive electrolytic copper material, thus ensuring a particularly noiseless connection and minimizing signal losses.

It is particularly expedient to dye the electrically insulating material of the outer plug, because a certain color code for allocation of connections has become generally accepted for consumer electronics devices. For example, it is common practice to use the colors red and white for stereophonic audio signals for the right and left channel, respectively. The yellow color designates a video connection.

Furthermore, with the socket being the subject of this invention, it is expedient for the outer plug and/or base body to consist of PTFE-plastic material. This material traded under the trade name "Teflon" is particularly resistant to temperature, which is advantageous, for example when an electrical conductor is affixed by soldering to the outer contact element. If a less temperature-resistant plastic material is used, the heating-up of the outer contact element thus occurring might cause damage to the outer plug and base body of the socket, respectively. Other temperature-resistant plastic materials, for example, PEEK materials, are also eligible for use.

An advantageous further embodiment of the socket consists in that the contact strip on the outside of the outer plug is subdivided into two helical sections or more which are connected via contact webs to a soldering plate. This configuration is particularly favorable in terms of the production process, if the outer contact element is produced as a metallic punched bending part. The helically shaped curve of the contact strip will then be available in the form of the two or more helical sections, with the technical advantages described hereinabove being achieved in the same manner as in case of a continuous helically shaped curve of the contact strip.

To solve the task being the subject of this invention, viz. to furnish a coaxial plug-in connector improved over the state of the art in technology, it is required to furnish not only a suitable socket but also an electrical connector plug which fits to it, because the properties of the connection relevant for the transmission of signals are determined by the overall system comprised of plug and socket.

Proceeding from an electrical connector plug of the initially described type, the present invention, therefore, solves the set of tasks and objectives furthermore by the fact that the outer contact element of the plug is designed and built as an electrically conductive contact tongue in its contact area, providing for electrically insulating clamping tongues radially spaced at a certain distance from the inner contact pin to hold the plug at one socket, said clamping tongues together with the contact tongue being pressed inwardly against the outside of a circular-cylindrically shaped outer plug of the socket by means of a clamping sleeve movably guided at the plug body.

Though the plug being the subject of the present invention is suitable for producing a coaxial plug-in connection with conventional RCA sockets, an improved plug-in connection in the sense of the present invention is brought about, if the plug together with the socket according to the present invention forms a coaxial plug-in connection system.

With the plug being the subject of this invention, the electrically conductive contact tongue is used as outer contact element, so that the outer contact element—other than with conventional RCA plugs—does not surround the inner contact pin entirely. Thus the capacitance of the plug-in connector in turn is reduced while the occurrence of eddy currents is prevented at the same time. To ensure a safe retention of the plug at the socket, electrically insulating clamping tongues are provided for, which by means of the clamping sleeve are pressed against the outside of the outer plug of the socket. According to the present invention, a particularly solid frictionally-locked connection of the plug with the socket is thus ensured. Other than with the plug according to WO 00/70717 mentioned hereinabove, the outer contact element with the plug of the present invention is actively pressed by the clamping sleeve against the outside of the outer plug of the socket. With the prior art plug, the compression force required for establishing the electrical contact is solely applied by the spring-resilient plastic material into which the pin-shaped outer contact of the plug is embedded. With the mechanical holder of the plug according to the present invention at the socket, the contact tongue and the clamping tongues, which are pressed by means of the clamping sleeve against the outer plug of the socket, act together. With the prior art plug, the mechanical retention of the plug at the socket in turn rests alone on the spring elasticity of the plastic material. Thus, by way of the present invention, a coaxial plug-in connection system is created which is improved over the state of the art in technology both electrically and mechanically.

A special advantage of the plug being the subject of the present invention is furthermore based upon the possibility to choose the surface of the contact tongue in such a manner that the impedance of the plugged connection is adapted to the wave resistance of the applied cable. The surface of the contact tongue exerts a decisive influence on the impedance of the plug. Particularly in case that the plug according to the present invention forms a coaxial plug-in connection system in combination with a socket according to the present invention, it is possible to arrange for an optimized impedance behavior of the coaxial electrical plug-in connection already during the production of the plug by suitably defining the surface of the contact tongue.

A further expedient embodiment of the connector plug being the subject of the present invention results from the fact that the contact tongue has a line-shaped elevation at its inside. Through the line-shaped elevation, the electrical contact with the outer contact element of the socket is established at a precisely defined place, which is of particular importance, if the plug is used in combination with the socket being the subject of the present invention. In that case, the line-shaped elevation of the contact tongue and the helically shaped contact strip of the socket overlap each other at least at one place on the outside of the outer plug of the socket. The contact surface of the plugged connection is precisely and reproducibly defined by the overlapping area and the impedance of the plugged connection in particular does not just depend upon how far the plug is inserted into the socket.

To ensure a safe contacting of the helical contact strip of the socket being the subject of the present invention, it is expedient, if the longitudinal axis of the contact tongue on part of the plug and/or the line-shaped elevation relative to the longitudinal axis of the connector plug being the subject of the present invention are aligned obliquely. In that case it is advantageous, if the line-shaped elevation of the plug and the contact strip of the socket overlap each other at an angle of basically 90°.

With the connector plug being the subject of the present invention, the contact tongue and/or clamping tongues expediently have a curvature that is adapted to the circular-cylindrical shape of the outer plug of the socket. Thus ensured is a superficial disposition of the clamping tongues at the outer plug of the socket on the one hand which is advantageous for the mechanical stability of the connection between plug and socket. Furthermore, if the contact tongue and the clamping tongues have conically shaped end sections at their outsides, this is advantageous for the pressing of the contact tongue and clamping tongues against the outside of the outer plug of the socket. For this purpose, the clamping sleeve comes to rest with its inside in the area of the conically shaped end sections at the outsides of the contact tongue and clamping tongues and is tensioned in axial direction against the plug body. To avoid any wear and tear occurring during this process at the contact tongue and clamping tongues, it is expedient for the clamping sleeve to consist of a base element and a ring element, which is pivoted to the base element, with the ring element with its inside attacking at the conically shaped end sections of the contact tongue and clamping tongues.

A low-cost and simple possibility for producing the electrical connector plug in accordance with the present invention is achieved, if the clamping tongues are adapted to the shape of the plug body. In this case, the plug body and the clamping tongues may, for example, consist of anodized aluminum. This material is an electrically insulating material and it has a particular hard surface, which is advantageous with regard to wear and tear at the clamping tongues. Alternatively, the clamping tongues can also be adapted to the shape of the carrier element for the inner contact pin. In that case it is possible to fix the clamping tongues by means of a detachable latching and plug-type connection at the carrier element. As the carrier element may consist of plastic material, it is not excluded that the clamping tongues molded to the carrier element might break off if the plug is improperly handled. Accordingly it is expedient, if the clamping tongues can be exchanged by means of the detachable latching or plug-type connection.

It is furthermore advantageous, if the outer contact element of the plug can be fixed at the carrier element by means of a detachable latching or plug-type connection. In this manner, the outer contact element can be replaced, which for example can be utilized in order to use outer contact elements with differently large contact tongues to vary the impedance of the plug-in connector, thus optimizing the adaptability to the wave resistance of the applied cable. Moreover, it is advantageous that the outer contact element can be detached from the carrier element, for example in order to solder the outer contact element with a cable. Thereby it is avoided that the carrier element, which might consist of a low-melting plastic material, is destroyed due to the heat transferred through the outer contact element during soldering.

In the sense of a high mechanical stability of the connection between plug and socket it is expedient, if the clamping tongues and the contact tongue with the connector plug being the subject of the present invention are arranged at equal space to each other at the outer circumference of the carrier element in circumferential direction. Particularly if the connector plug has two clamping tongues, a disposition of the plug at the socket together with the contact tongue effected through three points is ensured. On account of this triple-point retention it is ensured that the two clamping tongues as well as the contact tongue are equally pressed through the clamping sleeve against the outer plug of the socket. Thus it results a mechanically and electrically safe connection.

In accordance with a further expedient embodiment of the present invention, the connector plug has a latching connection, through which the electrically insulating carrier element is detachably fixed to the plug body. Certain advantages result hereof for assembly of the connector plug and soldering of a cable to the outer contact element and/or inner contact pin.

BRIEF DESCRIPTION OF THE DRAWINGS

Examples for embodiments of the invention are explained hereinafter based upon various figures, wherein.

DETAILED DESCRIPTION OF THE PREFERRED EMBODIMENTS

Figure 1:
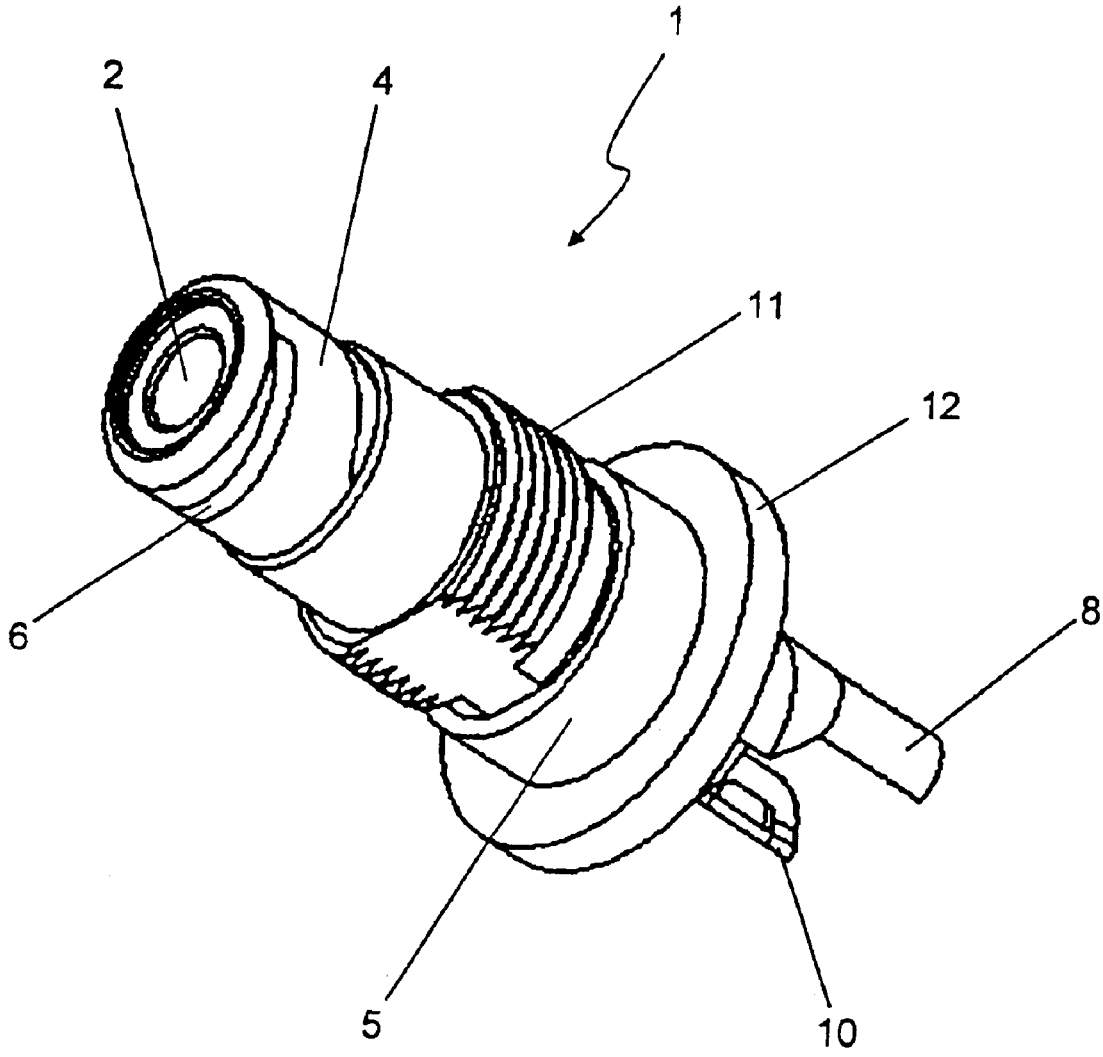
FIG. 1: shows a perspective view of a socket according to the present invention.
Figure 2:
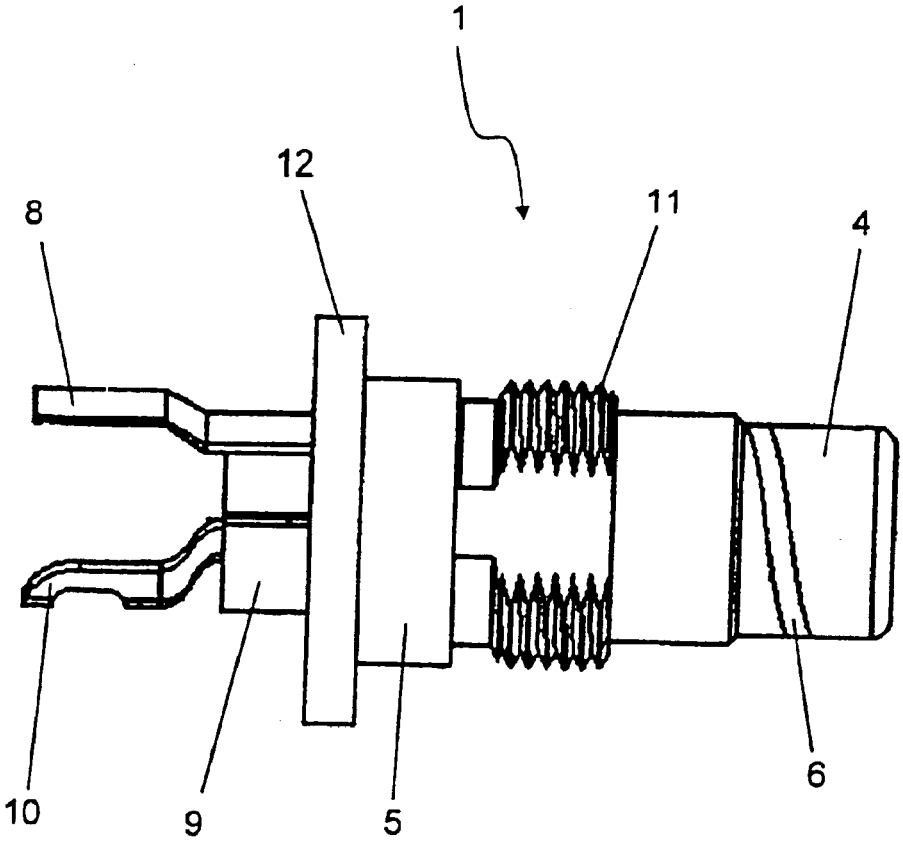
FIG. 2: shows a side view of the socket illustrated on FIG. 1.
Figure 3:
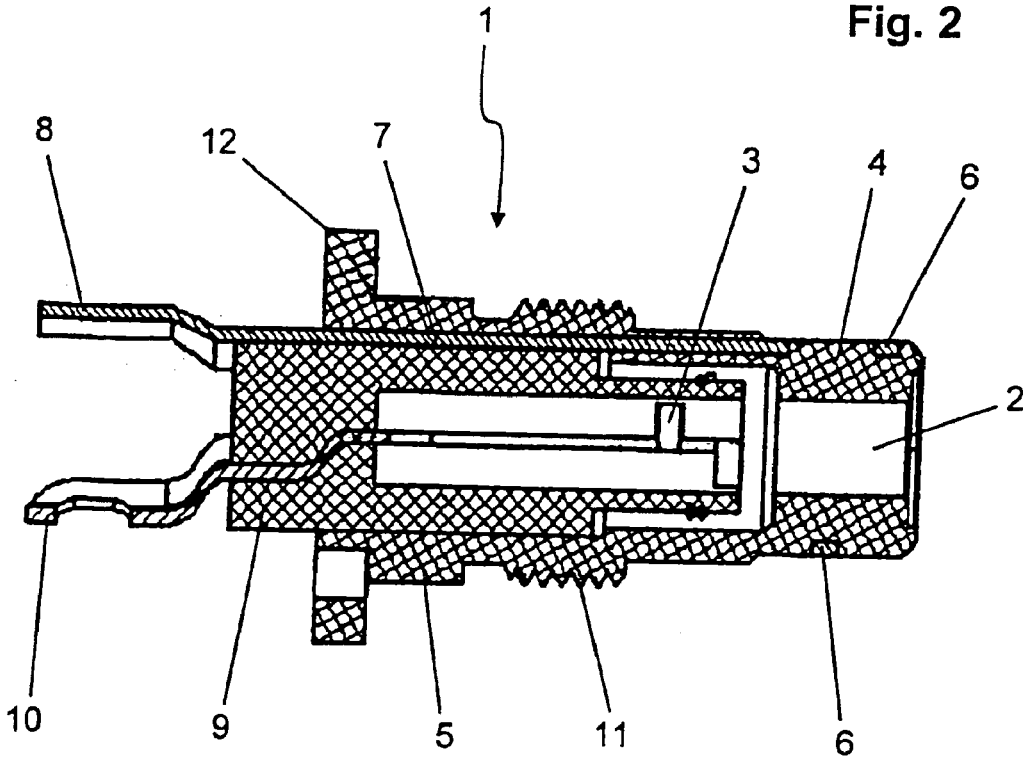
FIG. 3: shows a cross-sectional view of the socket according to the present invention.

FIGS. 1, 2, and 3 show a socket destined for case mounting which in its entirety is designated with reference number 1. Socket 1 at its front end has an inner contact opening 2, into which the inner contact pin of a plug, which fits to socket 1, is plugged-in. Located in the interior of the inner contact opening is an inner contact element 3 to establish the electrical contact with the inner contact pin of the plug. The inner contact opening 2 is surrounded by a circular-cylindrical outer plug 4, which consists of an electrically insulating material, for example PTFE plastic material. The outer plug 4 is of a one-partite construction with a base body 5 of socket 1. Serving as outer contact element, socket 1 has a contact strip 6, the curvature of which on the outside of the outer plug 4 forms a circular-cylindrical helical curve. The outer contact element is embedded as a metallic punched bending part 7 into the base body 5 of the socket 1. At the rear side of socket 1, the punched bending part 7 is designed and built as a contact plate 8, which a cable can be soldered to. As one may see on FIG. 3, the contact strip 6 is laid into a helical groove mounted at the outside of the outer plug 4. The contact element 3 is embedded into a carrier body 9 made of electrically insulating material, which is axially insertible into an appropriate bore of the base body 5, said bore mounted on the rear side of socket 1. At the rear side of socket 1, the inner contact element 3 in turn is designed and built as plate 10 so that a cable can be soldered on. At its outside, socket 1 has a threaded section 11. An appropriate nut can be screwed onto the thread, said nut fixing the socket 1 in combined action with a collar 12 molded to the base body of socket 1 at the wall of a casing into which socket 1 is built-in.

Figure 4:
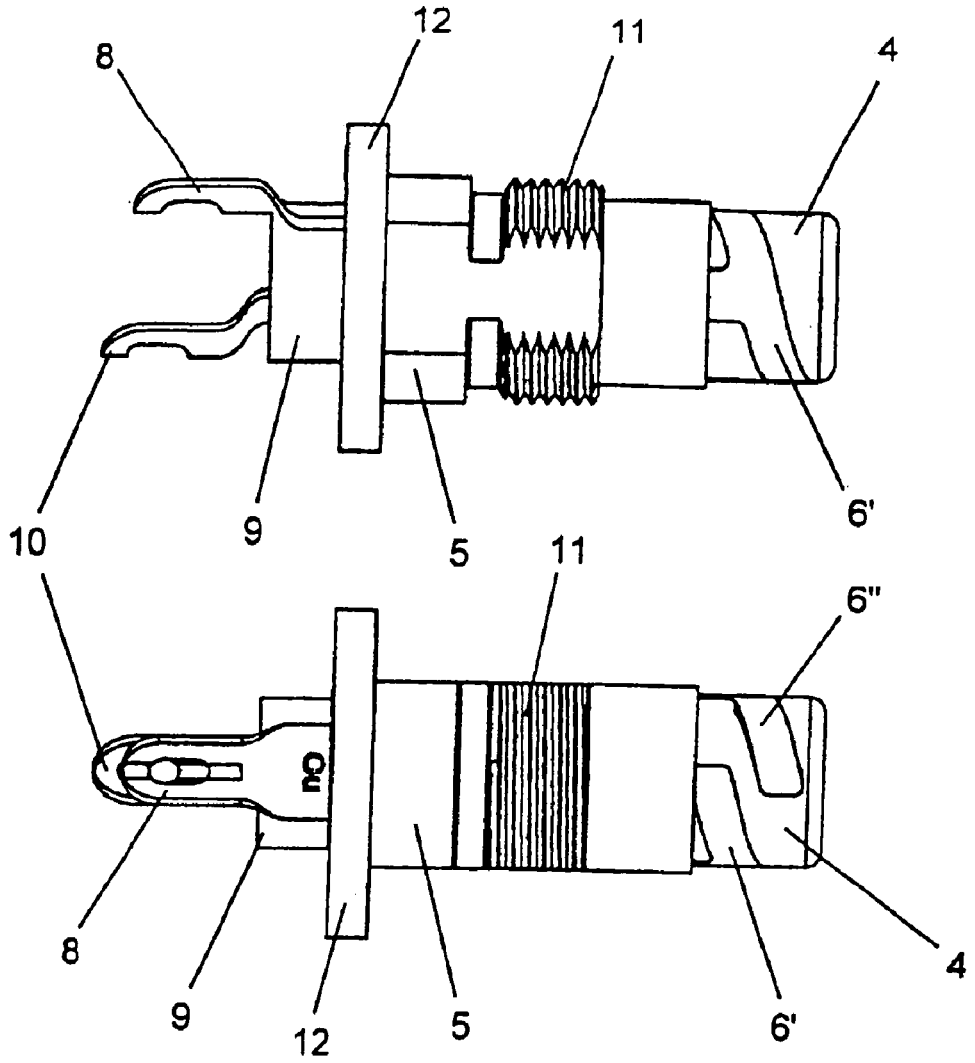
FIG. 4: shows side views of an alternative embodiment of the socket according to the present invention.
Figure 5:
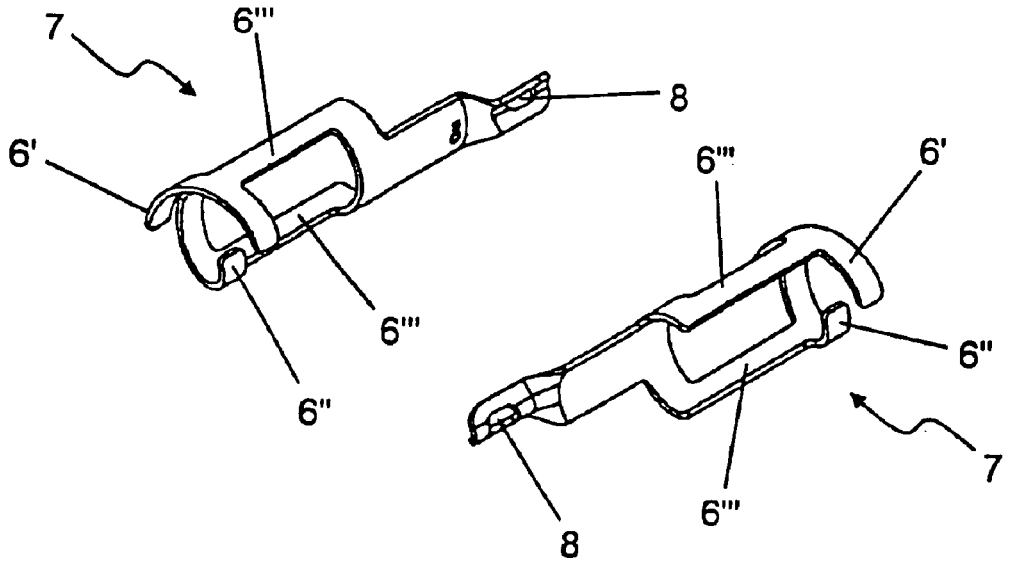
FIG. 5: shows an outer contact element produced as a punched bending part for the socket illustrated in FIG. 4.

FIG. 4 shows an alternative example of an embodiment of the socket being the subject of the present invention, by way of which one may readily see that the helical shape with the illustrated embodiment according to the present invention is brought about by the fact that the contact strip on the outside of the outer plug 4 is subdivided into two helix sections 6' and 6". FIG. 5 shows the shaping of the outer contact element produced as a punched bending part 7 made of copper of the socket illustrated in FIG. 4. The helix sections 6' and 6" are connected via contact webs 6'" with the soldering plate 8 for soldering a cable to the socket.

Figure 6:
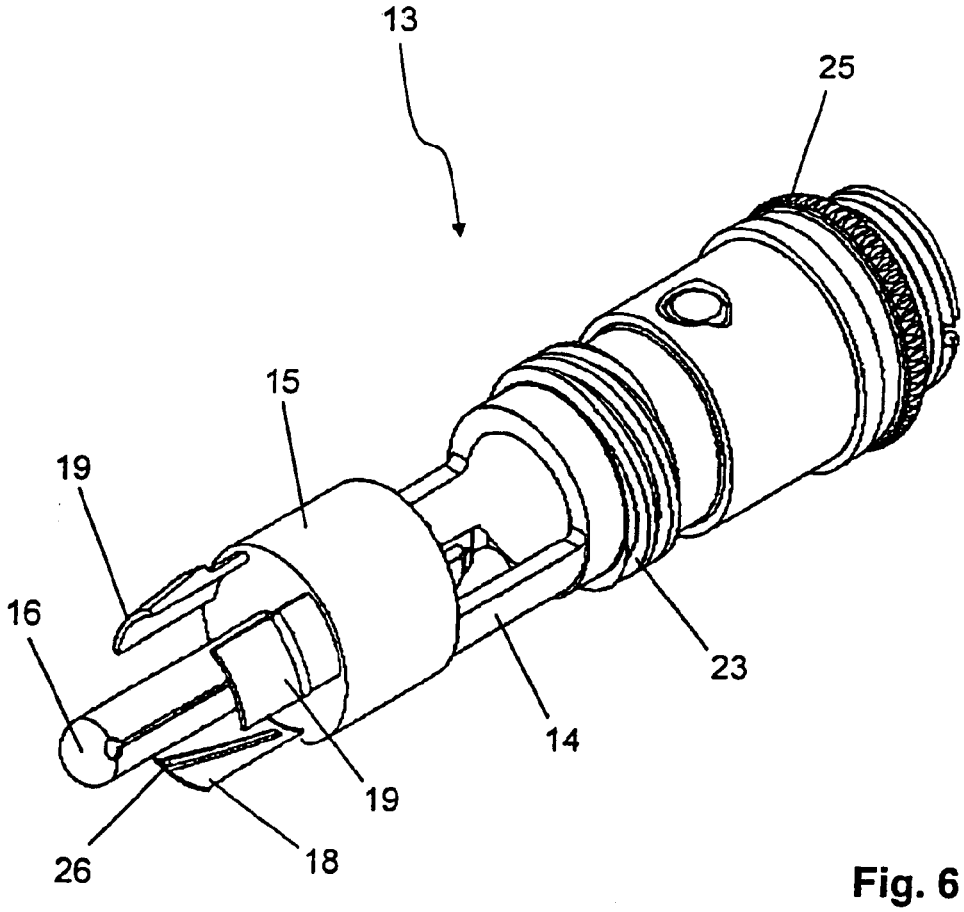
FIG. 6: shows a first perspective view of an electrical connector plug according to the present invention.
Figure 7:
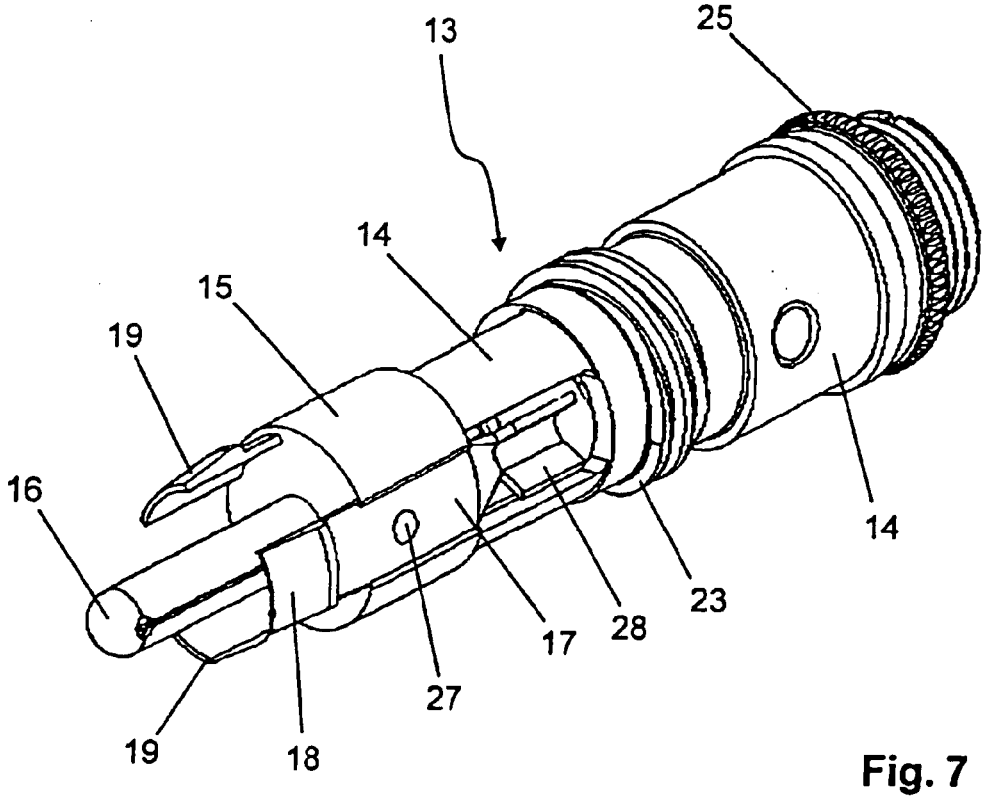
FIG. 7: shows a second perspective view of the plug illustrated in FIG. 4.
Figure 8:
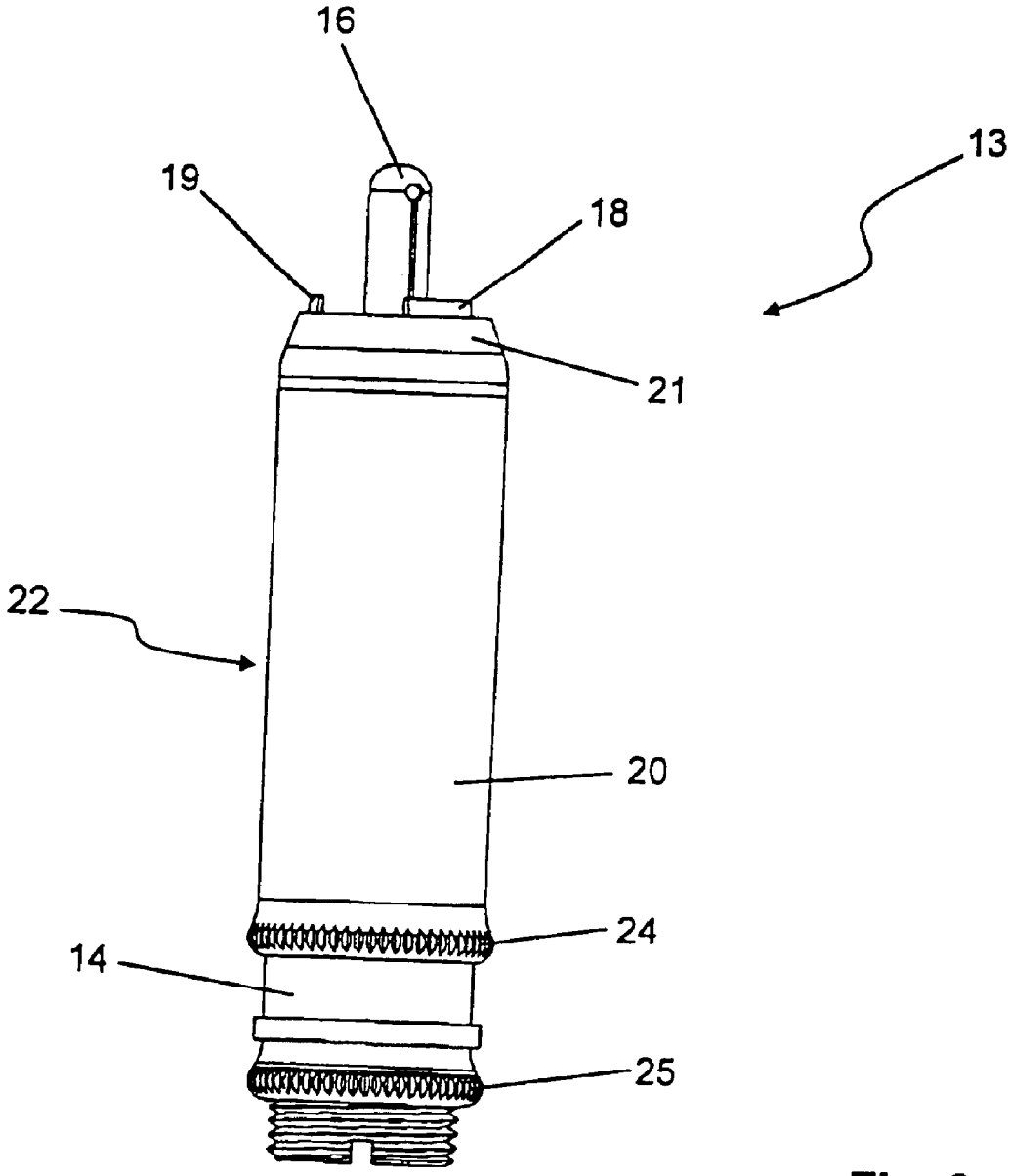
FIG. 8: shows a lateral view of the plug with a screwed-on clamping sleeve.

FIGS. 6, 7, and 8 show an electrical connector plug in accordance with the present invention, which in its entirety is designated with reference number 13. Plug 13 has a plug body 14, which an electrically insulating carrier element 15 for an inner contact pin 16 is affixed to. Moreover affixed to the carrier element 15 is an outer contact element 17 radially spaced relatively to the longitudinal axis of plug 13, said contact element being designed and built as an electrical conductive contact tongue 18 in its contact area. To retain plug 13 at a relevant socket, two electrically insulating clamping tongues 19 radially spaced from the inner contact pin 16 are provided which are molded to the carrier element 15 and built together with it as a one-partite construction. Alternatively, it is possible that the clamping tongues 19 can be fixed by means of a suitable detachable latching or plug-in connector at carrier element 15. Based upon FIGS. 6 and 7, it can be seen that the contact tongue 18 and the clamping tongues 19 have a curvature adapted to the circular-cylindrical shape of the outer plug of a relevant socket. Furthermore, at their outsides, the contact tongue 18 and the clamping tongues 19 have conically shaped end sections, at which a clamping sleeve 22 composed of a base element 20 and a ring element 21 attacks. By means of the clamping sleeve 22 guided axially movable at the plug body 14, the electrically insulating clamping tongues 19 together with the contact tongue 18 for retaining the plug 13 at a socket are pressed inwardly against the outside of the outer plug of the socket. The ring element 21 of the clamping sleeve 22 is pivoted to the base element 20, with the ring element 21 resting with its inside in the area of the conically shaped end sections at the outsides of the contact tongue 18 and clamping tongues 19. A thread 23 mounted at the plug body 14 serves for restraining the clamping sleeve 22 at the plug body 14. Knurled edges 24 and 25 mounted to the clamping sleeve 22 and to plug body 14, respectively, serve for ease of handling the plug 13 when restraining the clamping sleeve 22 on the plug body 13. As one can see on FIG. 6, the contact tongue 18 at its inside has a line-shaped elevation 26 through which the electrical contact with the outer contact of a socket is established. The line-shaped elevation 26 is obliquely arranged relative to the longitudinal axis of the connector plug 13. Based upon FIG. 7, it can be seen that the outer contact element 17 of plug 13 can be fixed by means of a detachable latching connection 27 at carrier element 15. The outer contact element 17 has a contact plate 28, which serves for contacting with a cable.

What is claimed is:

1. A socket (1) for a coaxial electrical plug-in connector, comprising an inner contact opening (2), having an inner contact element (3) arranged therein and comprising an outer plug (4) surrounding said inner contact opening (2) and being of a circular-cylindrical construction, said outer plug having an outer contact element, characterized in that said outer plug (4) consists of an electrically insulating material, with the outer contact element being designed and built as a contact strip (6) in its contact area, the curvature of said contact strip forming a circular-cylindrical helical curve on the outside of said outer plug (4).

2. A socket according to claim 1, characterized by a base body (5) consisting of an electrically insulating material, said base body being of a one partite construction with said outer plug (4), with the outer contact element being embedded as a metallic punched bending part (7) into said base body (5).

3. A socket as claimed in claim 1, characterized in that the pass height of the helical line basically corresponds to the length of said outer plug (4).

4. A socket as claimed in claim 1, characterized in that the inner contact element (3) and/or the outer contact element are made of highly conductive electrolytic copper.

5. A socket as claimed in claim 1, characterized in that the electrically insulating material of said outer plug is (4) is dyed.

6. A socket as claimed in claim 1, characterized in that said outer plug (4) and/or the base body (5) are made of PTFE-plastic material.

7. A socket as claimed in claim 1, characterized in that the contact strip (6) on the outside of the outer plug (4) is subdivided into two or more helix sections (6', 6"), which are connected via contact webs (6'") to a soldering plate (8).

8. A coaxial plug-in connection system with a socket (1) as claimed in claim 1 and a connector plug (13).

9. A socket as claimed in claim 1, characterized in that the contact strip (6) of the outer contact element is laid into a helical groove mounted at the outside of said outer plug (4).

10. A socket as claimed in claim 9, characterized in that the inner contact element (3) is embedded into a carrier body (9) made of electrically insulating material, said carrier body being axially insertible into an appropriate bore of said base body (5).

11. An electrical connector plug (13) with a plug body (14) which an electrically insulating carrier element (15) for an inner contact pin (16) is affixed to, and comprised of an outer contact element (17) radially spaced from the inner contact pin (16) relative to the longitudinal axis of said plug (13), characterized in that the outer contact element (17) is designed and built in its contact area as an electrically conductive contact tongue (18), with electrically insulating clamping tongues (19) radially spaced from the inner contact pin (16) being provided to retain said plug (13) at a socket, said clamping tongues together with the contact tongue (18) being inwardly pressed against the outside of a circular-cylindrical outer plug of the socket by means of a clamping sleeve (22) axially guided movable at the plug body (14).

12. An electrical connector plug as claimed in claim 11, characterized in that the contact tongue (18) has a line-shaped elevation (26) at its inside.

13. An electrical connector plug as claimed in claim 11, characterized in that the longitudinal axis of the contact tongue (18) and/or the line-shaped elevation (26) are obliquely aligned relative to the longitudinal axis of the connector plug (13).

14. An electrical connector plug as claimed in claim 11, characterized in that the contact tongue (18) and/or clamping tongues (19) have a curvature adapted to the circular-cylindrical shape of the outer plug of the socket.

15. An electrical connector plug as claimed in claim 11, characterized in that the clamping tongues (19) are adapted to the shape of the carrier element (15).

16. An electrical connector plug as claimed in claim 11, characterized in that the clamping tongues (19) can be fixed by means of a detachable latching or plug-in connector at said carrier element (15).

17. An electrical connector plug as claimed in claim 11, characterized in that the outer contact element (17) of said plug (13) can be fixed by means of a latching or plug-in connector (27) at said carrier element (15).

18. An electrical connector plug as claimed in claim 11, characterized in that the electrically insulating carrier element (15) is detachably fixed at the plug body (14) by means of a latching connection.

19. An electrical connector plug as claimed in claim 11, characterized in that the contact tongue (18) and the clamping tongues (19) have conically shaped end sections at their outsides.

20. An electrical connector plug as claimed in claim 19, characterized in that the clamping sleeve (22) is comprised of a base element (20) and a ring element (21), which is pivoted to said base element (20), with the ring element (21) resting with its inside in the area of the conically shaped end sections at the outsides of the contact tongue (18) and clamping tongues (19).

21. An electrical connector plug as claimed in claim 11, characterized in that the clamping tongues (19) are molded to said plug body (14).

22. An electrical connector plug as claimed in claim 21, characterized in that the plug body (14) and the clamping tongues (19) are made of anodized aluminum.

23. An electrical connector plug as claimed in claim 11, characterized in that the clamping tongues (19) and the contact tongue (18) are arranged at equal spaces to each other on the outer circumference of the carrier element in circumferential direction.

24. An electrical connector plug as claimed in claim 23, characterized in that the connector plug (13) has two clamping tongues (19).

* * * * *